US005296645A

United States Patent [19]

Zwadlo et al.

[11] Patent Number: 5,296,645

[45] Date of Patent: Mar. 22, 1994

[54] LIQUID TONER DEVELOPING MODULE FOR ELECTROGRAPHIC RECORDING

[75] Inventors: Gregory L. Zwadlo; George J. Kramer, both of St. Paul, Minn.

[73] Assignee: Minnesota Mining and Manufacturing, Saint Paul, Minn.

[21] Appl. No.: 885,491

[22] Filed: May 19, 1992

Related U.S. Application Data

[62] Division of Ser. No. 509,732, Apr. 16, 1990, Pat. No. 5,120,630.

[51] Int. Cl.[5] ..... G03G 15/10

[52] U.S. Cl. ..... 118/647; 355/256

[58] Field of Search ..... 355/256, 257, 258, 261; 118/647, 661; 430/103, 117, 118, 119

[56] References Cited

U.S. PATENT DOCUMENTS

| | | | |
|---|---|---|---|
| 3,461,843 | 8/1969 | Noon . | |
| 3,901,188 | 8/1975 | Eberlin . | |
| 3,916,828 | 11/1975 | Gross . | |
| 3,927,639 | 12/1975 | Plumadore . | |
| 3,964,436 | 6/1976 | Plumadore | 118/647 |
| 3,972,305 | 8/1976 | Sato . | |
| 3,972,610 | 8/1976 | Gross . | |
| 4,141,647 | 2/1979 | Lempke et al. . | |
| 4,203,386 | 5/1980 | Blöchl et al. | 118/657 X |
| 4,398,818 | 8/1983 | Jeromin et al. . | |
| 4,728,987 | 3/1988 | Diola et al. . | |
| 4,793,281 | 12/1988 | Dobbins et al. | 118/650 |
| 4,796,051 | 1/1989 | Monkelbaan et al. . | |
| 4,878,090 | 10/1989 | Lunde . | |

FOREIGN PATENT DOCUMENTS

| | | | |
|---|---|---|---|
| 121592B1 | 4/1989 | European Pat. Off. . | |
| 242501 | 1/1987 | Fed. Rep. of Germany | 430/117 |

*Primary Examiner*—R. L. Moses

*Attorney, Agent, or Firm*—Kinney & Lange

[57] ABSTRACT

A developing module for depositing liquid toner on an imaging surface of a photoconductive member includes a development electrode. The development electrode is supported by a shroud which includes a toner supply passageway. The supply passageway is coupled to a pump mechanism that delivers liquid toner to the development electrode from a supply sump. Liquid toner flowing across the development electrode is deposited on the imaging surface of the photoconductive member. The shroud further includes a toner return passageway coupled to a vacuum source. The vacuum source removes from the development electrode liquid toner that has not been deposited on the imaging surface of the photoconductive member. In addition, the vacuum source removes air from around the development electrode. A vacuum chamber is mounted to the shroud adjacent the toner return passageway and is further coupled to the vacuum source. The vacuum chamber separates the air drawn off of the development electrode from the undeposited liquid toner.

7 Claims, 4 Drawing Sheets

LIQUID TONER DEVELOPING MODULE FOR ELECTROGRAPHIC RECORDING

This is a divisional of application Ser. No. 07/509,732, filed Apr. 16, 1990, now U.S. Pat. No. 5,120,630.

BACKGROUND OF THE INVENTION

This invention pertains generally to multicolor electrographic recording devices. In particular, the present invention is a liquid toner developing module used to deposit liquid toner onto a latent electrostatic image formed on an imaging surface of a photoconductive member.

Typically, to produce a multicolor print a photoconductive member of an electrographic recording device is first charged to a uniform potential to sensitize its imaging surface. The charged surface of the photoconductive member is exposed to an image of an original document that is to be reproduced as a multicolor print. This procedure allows the photoconductive member to record an electrostatic latent image corresponding to the informational areas contained within the image of the original document.

To form a multicolor print, successive images of the original document are digitally color separated through different colored filters and recorded on the photoconductive member. These latent images are developed with different colored liquid toners supplied from corresponding toner developing modules of a toner handling network. The color of the liquid toner in a particular developing module corresponds to the subtractive primary of the color of the respective digitally separated image. Electrographic recording is normally done with yellow, cyan and magenta liquid toners. Usually the electrographic recording device also includes a developing module having black liquid toner, since it is required in virtually all commercial color printing applications. The different colored developed images are transferred from the photoconductive member to a print medium in superimposed registration with one another. Heat is usually applied to permanently fuse the image to the print medium to form a completed multicolor print.

One such liquid toner developing chamber for depositing liquid toner on an electrophotographic film is disclosed in U.S. Pat. No. 3,927,639 to Plumadore. The developing chamber includes a development electrode positioned beneath an opening in a liquid toner chamber passageway. Liquid toner is supplied through the chamber passageway opening to be deposited on an electrophotographic film placed against the opening. Liquid toner is supplied to the chamber passageway through an inlet which is coupled to a toner reservoir containing a supply of liquid toner. The toner reservoir is coupled to the inlet by a fluid line that includes a solenoid valve.

The chamber passageway further includes an outlet spaced from the inlet by the development electrode. Liquid toner that is not deposited on the electrophotographic film passes through the chamber passageway and out the developing chamber outlet. A toner vacuum separator is coupled in series with the outlet and a vacuum pump. The vacuum pump when activated, draws liquid toner from the toner reservoir through the chamber passageway to the toner vacuum separator. The toner vacuum separator separates liquid toner (that has not been deposited on the electrophotographic film and is recovered from the chamber passageway) from any air drawn into the separator from the passageway by operation of the vacuum pump. Separated toner within the toner vacuum separator is returned to the toner reservoir through a toner return line.

Air to dry the liquid toner deposited on the electrophotographic film is supplied to the chamber passageway through a conduit coupled to the developing chamber inlet. The air is drawn through the chamber passageway by operation of the vacuum pump. The vacuum pump of the developing chamber must operate at a high vacuum pressure to draw the liquid toner from the toner reservoir and through the chamber passageway to the toner vacuum separator. The high flow rate of the liquid toner through the chamber passageway may cause bubbles to form in the toner. Bubbles within the liquid toner may distort the image on the electrophotographic film since the bubbles may not allow the toner to be evenly and continuously deposited on the film. In addition, the high toner flow rate can cause the liquid toner to mist making it difficult for the toner vacuum separator to effectively and efficiently separate the undeposited toner from the air drawn in by the operation of the vacuum pump.

There is a continuing need for improved liquid toner developing modules for depositing liquid toner on an imaging surface of a photoconductive member. In particular, there is a need for a developing module that uses a low vacuum pressure to remove liquid toner from the development electrode to reduce the likelihood that bubbles will form in the liquid toner flow. The absence of bubbles will allow the toner to be evenly deposited on the photoconductive member, and thereby lessen any chance of distorting the toned electrostatic latent image on the imaging surface. In addition, there is a need for a developing module that uses a low vacuum pressure to recover undeposited toner from the development electrode to prevent the liquid toner from misting. Reduced misting allows the undeposited toner to be effectively separated from the air drawn in by the vacuum pump from around the development electrode. There is a need to simplify the toner carrying lines and valving of the developing module for efficient liquid toner handling. Moreover, there is a need for a method of aligning the development electrode of the developing module with photoconductive member that allows the liquid toner to be gradually applied to the imaging surface of the photoconductive member to ensure a high quality developed image.

SUMMARY OF THE INVENTION

The present invention is a liquid toner developing module used to deposit liquid toner onto an imaging surface of a photoconductive member. The developing module includes a development electrode that is configured to be positioned in spaced proximity to the imaging surface of the photoconductive member. The development electrode is supported by a shroud and a pump mechanism coupled to the shroud provides a supply of liquid toner to the development electrode. A vacuum mechanism that includes a vacuum source is further coupled to the shroud and draws liquid toner that has not been deposited on the imaging surface of the photoconductive drum from the development electrode. In addition to the undeposited toner, the vacuum source also skives air from around the development electrode. A vacuum chamber mounted to the shroud and coupled to the vacuum source separates undeposited toner from the air skived off of the development electrode by the vacuum source.

A liquid toner supply sump is associated with the shroud and contains a supply of liquid toner. A toner supply passageway formed in the shroud is positioned adjacent the development electrode. The pump mechanism is coupled to the supply sump and the toner supply passageway and is configured to pump toner from the sump, through the toner supply passageway to the development electrode. The developing module further includes a toner return passageway formed in the shroud and spaced from the toner supply passageway by the development electrode. The toner return passageway includes an outlet portion that is submerged beneath the surface of the supply of liquid toner contained within the supply sump. The vacuum chamber includes an outlet orifice coupled to the vacuum source and an inlet orifice coupled to the toner return passageway at a location above the outlet portion. A toner overflow passageway positioned adjacent the toner supply passageway allows liquid toner that is not deposited on the photoconductive member or removed from the development electrode by the vacuum source to be returned to the supply sump.

The supply sump of the developing module further includes an inlet line configured to allow toner concentrate and toner carrier to be added to the supply sump. An outlet line on the supply sump allows excess liquid toner to be removed from the sump.

The pump mechanism pumps liquid toner from the supply sump, through the supply passageway to the development electrode. As the toner flows across the development electrode it is deposited on the imaging surface of the photoconductive member. The vacuum source provides vacuum pressure through the vacuum chamber and the toner return passageway to draw toner that has not been deposited on the imaging surface from the development electrode. In addition to the undeposited toner the vacuum source skives air from around the development electrode. Undeposited liquid toner flows down the return passageway to the sump through the outlet portion, while the skived air is separated from undeposited toner by the vacuum pressure applied by the vacuum source through the vacuum chamber. In addition, liquid toner that does not reach the return passageway or is not deposited on the photoconductive member returns to the supply sump via the overflow passageway.

To align the development electrode of the developing module with a rotating photoconductive member, the module is moved from a predeveloping position spaced from the photoconductive member to a developing position wherein the development electrode is in closely spaced proximity to the photoconductive member. Movement of the development electrode between the predeveloping and developing positions is along an alignment plane which is tangent to a radial line extending from the laterally extending axis of the rotating photoconductive member. As the development electrode sweeps longitudinally in along the alignment plane and thereby approaches the developing position, liquid toner flowing across the development electrode contacts the imaging surface of the photoconductive member and is deposited thereon. After the latent electrostatic image on the imaging surface has been completely toned, the development electrode moves back along the alignment plane from the developing position to the predeveloping position. As the development electrode sweeps longitudinally out along alignment plane, vacuum pressure (provided by the vacuum source through the toner return passageway) removes any excess liquid toner that may be clinging to the imaging surface of the photoconductive member.

This liquid toner developing module is relatively simple and since it includes a vacuum chamber mounted adjacent to the toner return passageway, the vacuum source can operate at a lower vacuum pressure which thereby reduces liquid toner misting. Reduced misting allows the skived air to be effectively and efficiently separated from the undeposited liquid toner, thereby eliminating the need for a toner vacuum separator spaced from the developing module and the attendant fluid lines.

In addition, the reduced vacuum pressure lessens the likelihood that bubbles will form in a liquid toner as it moves past the photoconductive member, and thereby lessens the chance that the toned electrostatic latent image on the imaging surface will be distorted. The development electrode of the developing module is aligned with the imaging surface by sweeping the development electrode in along the alignment plane. This sweep alignment allows the liquid toner on the development electrode to be gradually applied to the imaging surface and thereby ensures a high quality developed image. In addition, sweeping the development electrode from the developing position back to the predeveloping position allows the vacuum source to remove excess liquid toner from the imaging surface of the photoconductive member.

DETAILED DESCRIPTION OF THE PREFERRED EMBODIMENT DEVELOPING MODULE COMPONENTS AND STRUCTURE

Figure 1:
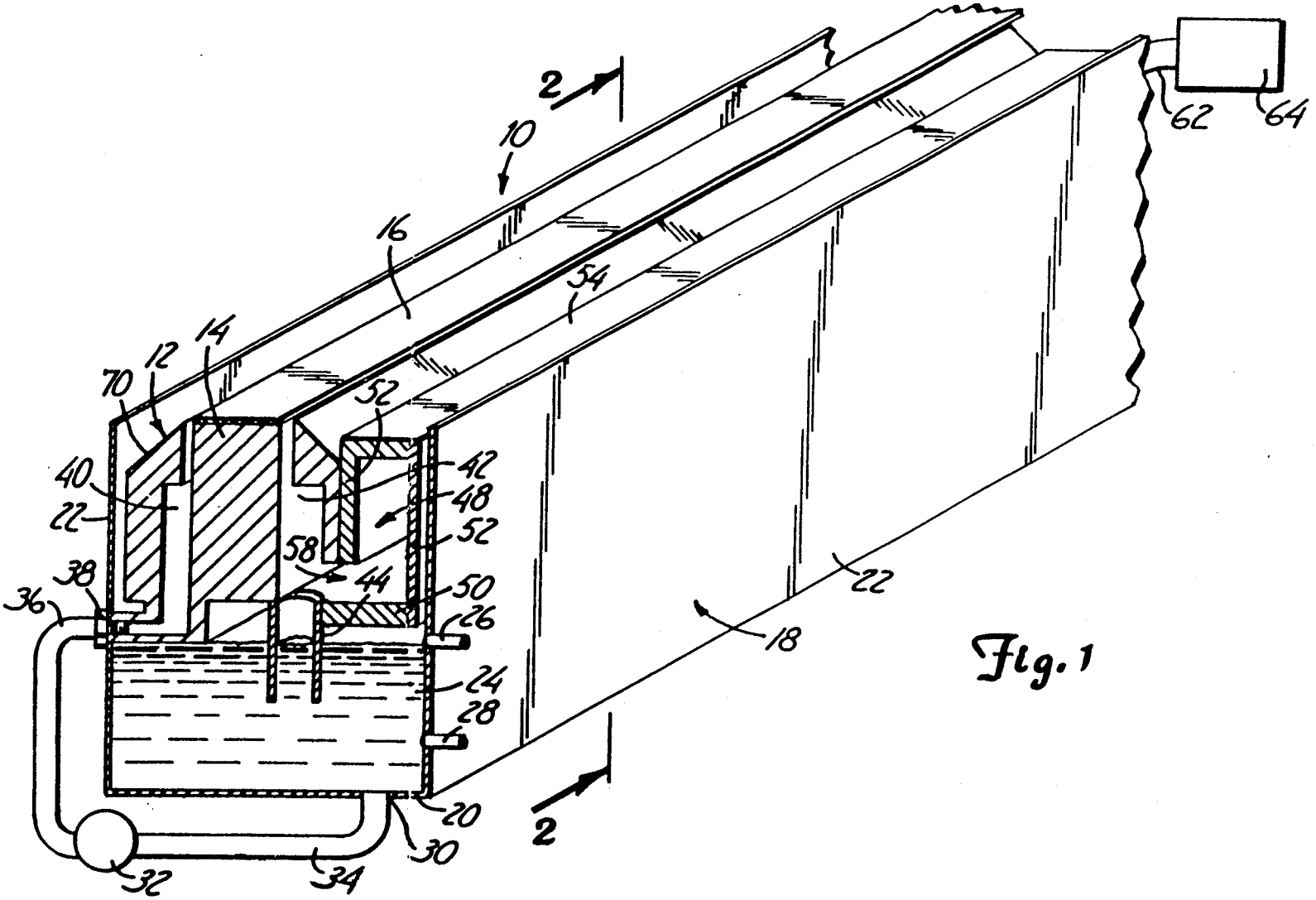
FIG. 1 is a partial perspective view with portions in section which shows the developing module of the present invention.
Figure 2:
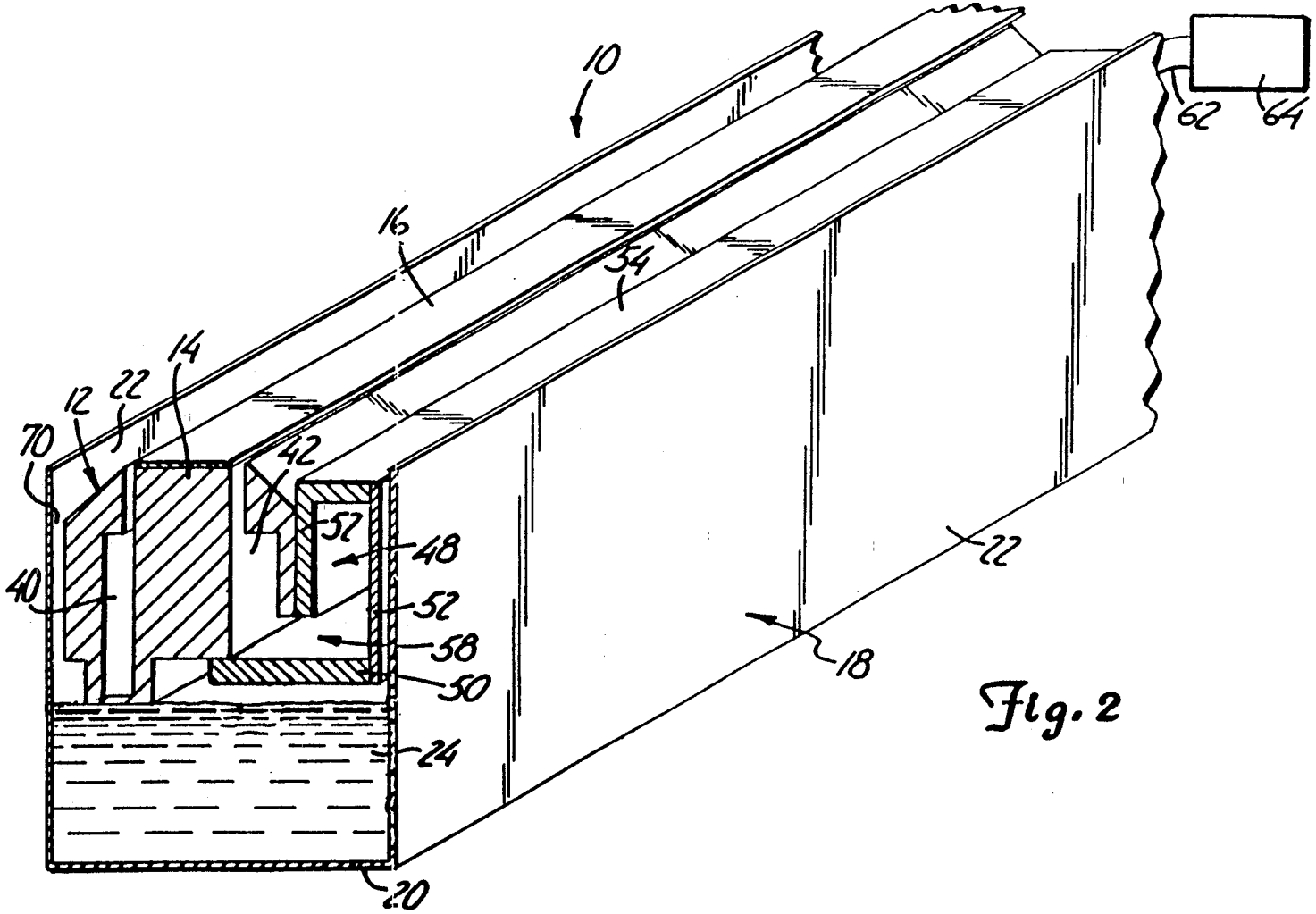
FIG. 2 is a partial perspective view with portions in section taken along line 2—2 in FIG. 1.

A developing module 10 in accordance with the present invention is illustrated generally in FIGS. 1 and 2. The developing module 10 includes a shroud 12 having a base member 14 for supporting a development electrode 16. The development electrode 16 is formed of a conductive material,, such as stainless steel and is configured to carry a film of liquid toner for use in a developing process.

The shroud 12 is surrounded by a liquid toner supply sump 18 that includes a base wall 20, a pair of side walls 22 and a pair of end walls (not shown). The supply sump 18 is configured to contain a supply of liquid toner 24. The liquid toner supply sump 18 further includes a supply sump inlet line 26 extending through one of the side walls 22 that allows toner concentrate and toner carrier to be added to the supply sump 18 to formulate the liquid toner 24. A supply sump outlet line 28 extending through one of the side walls 22 near the base wall 20 is configured to allow excess liquid toner 24 to be removed from the supply sump 18.

As seen in FIGS. 1 and 2, the supply sump 18 further includes an outlet port 30 coupled to a pump mechanism 32 by way of a pump inlet line 34. A pump outlet line 36 is coupled for liquid toner flow to an inlet portion 38 of a toner supply passageway 40 formed in the shroud 12. The pump mechanism 32 is configured to draw liquid toner 24 from the supply sump 18 and deliver the liquid toner 24 through the toner supply passageway 40 to the development electrode 16.

The developing module further includes a toner return passageway 42 formed in the shroud 12 and spaced from the supply passageway 40 by the development electrode 16. As seen in FIG. 1, the toner return passageway 42 has an outlet portion 44, such as a tube, that is partially submerged beneath the surface of the liquid toner 24 contained within the supply sump 18.

Figure 3:
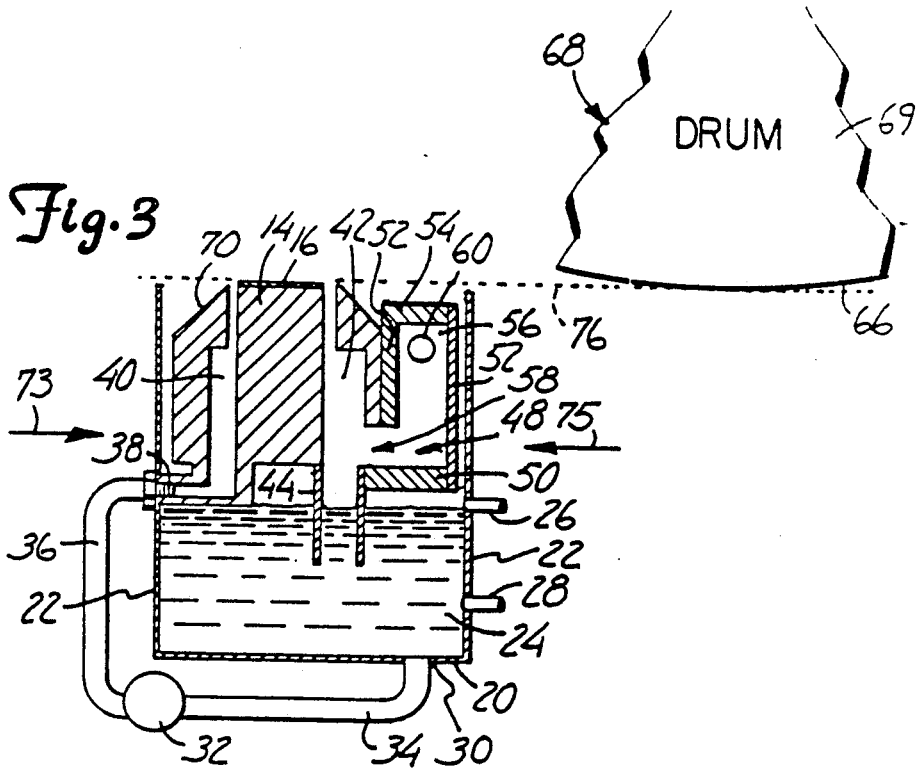
FIG. 3 is a sectional view of the developing module shown in FIG. 1 in a predeveloping position spaced from the photoconductive member.
Figure 4:
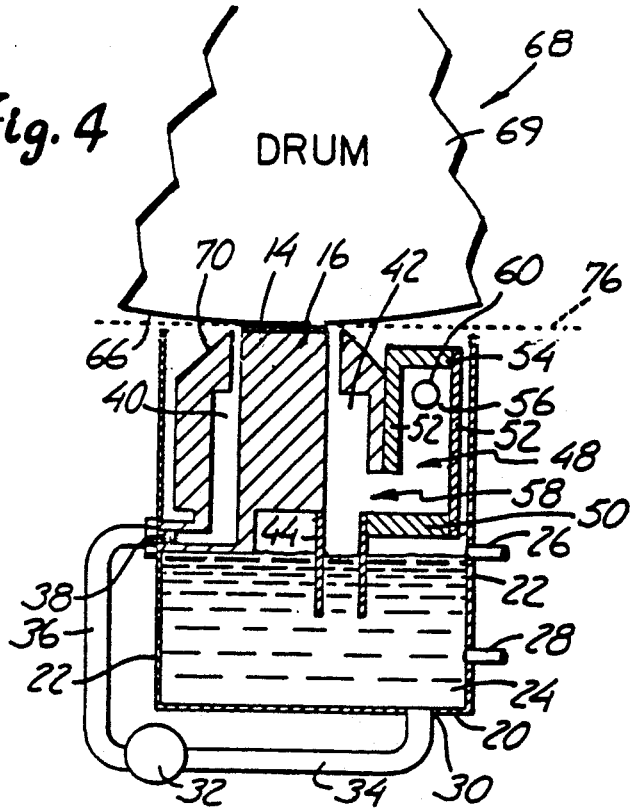
FIG. 4 is a sectional view similar to FIG. 3, but with the developing module in a developing position closely adjacent the photoconductive member.

A vacuum chamber 48 is mounted to the shroud 12 adjacent the toner return passageway 42. The vacuum chamber 48 is defined by a bottom wall 50, a pair of side walls 52, a top wall 54 and a pair of end walls 56 (one of which is shown in FIGS. 3 and 4) . An inlet orifice 58 extends through one of the side walls 52 between the vacuum chamber 48 and the toner return passageway 42 at a location above the outlet portion 44. The vacuum chamber 48 has an outlet orifice 60 extending through one of the end walls 56 (see FIGS. 3 and 4). As illustrated in FIG. 1, a conduit 62 is connected to the outlet orifice 60 and couples the vacuum chamber 48 to a vacuum source 64, such as a vacuum pump.

Figure 5:
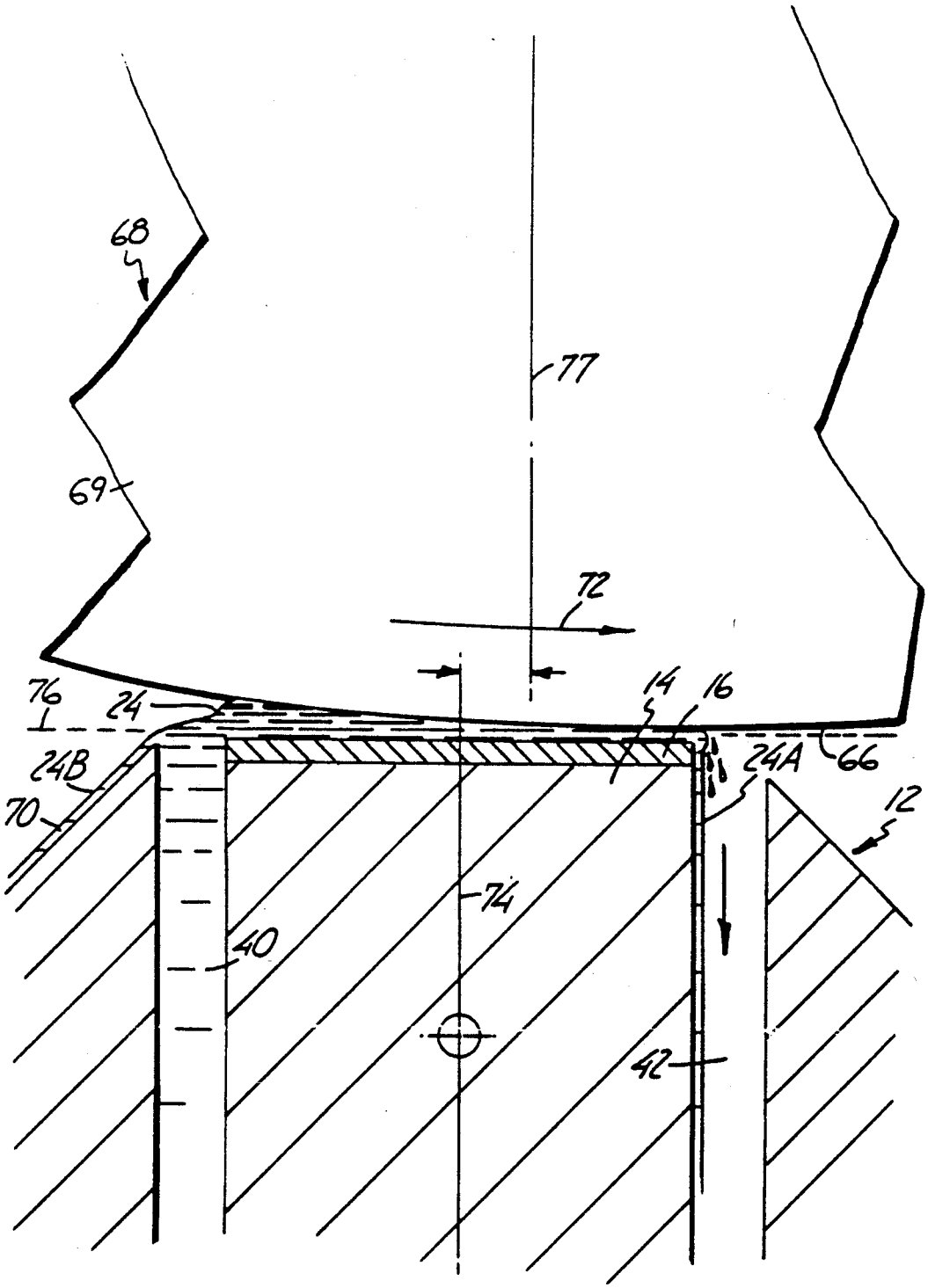
FIG. 5 is an enlarged sectional view of the developing module in the developing position and showing the liquid toner being deposited on the photoconductive member.

The pump mechanism 32 pumps liquid toner 24 from the supply sump 18, through the supply passageway 40 to the development electrode 16. As seen in FIG. 5, the toner 24 flows across the development electrode 16 and is deposited on a latent electrostatic image formed on an outer circumferential imaging surface 66 of a photoconductive member 68, such as a photoconductor drum 69. The vacuum source 64 when activated provides low vacuum pressure through the vacuum chamber 48 and the toner return passageway 42 to draw toner 24A that has not been deposited on the imaging surface 66 away from the development electrode 16. In addition to the undeposited toner 24A the vacuum source 64 skives air from around the development electrode 16. Undeposited liquid toner 24A flows down the return passageway 42 to the supply sump 18 through the outlet portion 44, while the skived air is separated from the undeposited toner 24A by the vacuum pressure applied by the vacuum source 64 through the vacuum chamber 48. Vacuum pressure from the vacuum source 64 causes some back pressure in the outlet portion 44. This back pressure draws liquid toner 24 contained within the supply sump 18 partially up the outlet portion 44. However, the back pressure is not great enough to draw liquid toner 24 up the outlet portion 44, such that the inlet orifice 58 could become blocked with liquid toner 24 and undeposited liquid toner 24A during the developing process. As seen in FIGS. 2 and 5, the developing module 10 further includes a toner overflow passageway 70 located adjacent to the toner supply passageway 40 and in fluid communication with the supply sump 18 (see FIG. 2). As seen in FIG. 5, liquid toner 24B that does not reach the return passageway 42 and is not deposited on the photoconductive member 68 returns to the supply sump 18 via the toner overflow passageway 70.

DEVELOPING MODULE OPERATION

To deposit liquid toner 24 on the latent electrostatic image on the outer circumferential imaging surface 66 (i.e., to perform the developing process), the development electrode 16 must be aligned with the outer circumferential imaging surface 66 of the photoconductor drum 69. To accomplish this alignment, the pump mechanism 32 is activated with the developing module 10 in a predeveloping position spaced from the photoconductor drum 69 (see FIG. 2). The pump mechanism 32 delivers liquid toner 24 to the development electrode 16 from the supply sump 18 through the supply passageway 40. With the developing module 10 in the predeveloping position, the vacuum source 64 is activated. The vacuum source 64 provides low vacuum pressure through the vacuum chamber 48 and the return passageway 42 and draws undeposited liquid toner 24A away from the development electrode 16. In addition to the toner 24A the vacuum source 64 skives air from around the development electrode 16. The undeposited liquid toner 24A flows down the return passageway 42 to the supply sump 18 through the outlet portion 44, while the skived air is separated from toner 24A by the vacuum pressure applied by the vacuum source 64 through the vacuum chamber 48. When the liquid toner 24 flowing across the development electrode 16 is not in contact with the imaging surface 66 of the photoconductor drum 69 (as in the predeveloping position), undeposited liquid toner 24A comprises any liquid toner 24 that does not return to the supply sump 18 via the overflow passageway 70.

This recirculation of liquid toner 24 from the supply sump 18, across the development electrode 16 and back to the supply sump 18, mixes together toner concentrate and toner carrier that have been added to the supply sump 18 through the inlet line 26 to form liquid toner 24. In addition, this recirculation of liquid toner 24 remixes liquid toner 24 already contained within the supply sump 18 that may have separated into its component liquid parts as a result of nonuse.

Next, the photoconductor drum 69 is actuated to rotate in a counterclockwise direction about its laterally extending axis as viewed in FIG. 5 and represented by the directional arrow 72. As the toner 24 is being recirculated from the sump 18 to the development electrode 16 and back to the sump 18, the module 10 is moved in a first linear direction as represented by directional arrow 73 (see FIG. 3). The module 10 moves from the predeveloping position shown in FIG. 3 toward a developing position shown in FIGS. 4 and 5. During this movement the development electrode 16 of the module 10 moves longitudinally along an alignment plane 76 which is tangent to a radial line 77 (see FIG. 5) extending outwardly from the laterally extending axis of the photoconductor drum 69. Since the drum 69 is rotating counterclockwise the relative movement of the drum 69 and development electrode 16 of the module 10 is generally the same. The return passageway 42 (and thereby the vacuum pressure from the vacuum source 64) approaches the outer circumferential imaging surface 66 of the drum 69 before the development electrode 16. By sweeping the development electrode 16 in along the alignment plane 76, the liquid toner 24 is applied to the outer circumferential imaging surface 66 in a gradual and tangential manner.

In the developing position as shown in FIGS. 4 and 5, the toner 24 flows across the development electrode 16 and through a development gap formed between the outer circumferential imaging surface 66 of the drum 69 and the electrode 16. During this developing process, the development electrode 16 is aligned with the outer circumferential surface 66 of the photoconductor drum 69. The module 10 is held stationary while liquid toner 24 is deposited on the imaging surface 66 of the rotating photoconductor drum 69. As seen in FIG. 5, the longitudinally extending centerline 74 of the development electrode 16 is to the left of the radial line 77 of the drum 69, so that the density of the toner 24 remains uniform as it is drawn through the development gap by the vacuum pressure from the vacuum source 64.

Toner 24A that has not been deposited on the imaging surface 66 is drawn into the return passageway 42 by the vacuum pressure. In addition to the undeposited toner 24A, the vacuum source 64 skives air from around the development electrode 16. Undeposited liquid toner 24A flows down the return passageway 42 to the supply sump 18 through the outlet portion 44, while the skived air is separated from undeposited toner 24A by the vacuum pressure applied by the vacuum source 64 through the vacuum chamber 48. As seen in FIG. 5, liquid toner 24B that does not reach the return passageway 42 and is not deposited on the photoconductor drum 69 returns to the supply sump 18 via the toner overflow passageway 70.

Once the latent electrostatic image on the imaging surface 66 has been completely toned the pump mechanism 32 is deactivated and any toner 24 remaining on the development electrode 16 is drawn off by the vacuum source 64. The module 10 is then moved in a second linear direction as represented by the directional arrow 75 so that the development electrode sweeps longitudinally back along the alignment plane 76 to the predeveloping position. During this sweep out movement, relative movement between the module 10 and the outer circumferential imaging surface 66 of the drum 69 is generally opposite. In addition, during movement of the module 10 in the second direction, the vacuum source 64 continues to operate, and thereby removes any excess toner 24 that may be clinging to a trailing edge of the imaging surface 66 of the rotating drum 69. This procedure eliminates the need for toner recovery blades and air knifes used by previous electrographic recording devices to remove excess toner from photoconductive members. Moreover, this procedure effectively removes excess toner 24 from the imaging surface 66 that may otherwise affect the quality of the toned, latent electrostatic image formed thereon. With the developing module 10 back in the predeveloping position shown in FIG. 3, the vacuum source 64 is deactivated. The photoconductor drum 69 continues to rotate until the toned, latent electrostatic image on the outer circumferential imaging surface 66 is transferred to a print medium to complete the developing process.

This liquid toner developing module 10 is relatively simple and since it includes a vacuum chamber 48 mounted adjacent to the toner return passageway 42, the vacuum source 64 can operate at a lower vacuum pressure which thereby reduces liquid toner misting. Reduced misting allows the skived air to be effectively and efficiently separated from the undeposited liquid toner 24A, thereby eliminating the need for a toner vacuum separator spaced from the developing module 10 and the attendant fluid lines. During the developing process, the vacuum chamber 48 allows undeposited liquid toner 24A to be returned to the supply sump 18, unlike in previous electrographic recording devices in which the undeposited liquid toner is stored within a toner vacuum separator. The vacuum chamber 48 allows the undeposited liquid toner 24A to be immediately resupplied to the development electrode 16 during the course of the developing process. In addition, the reduced vacuum pressure lessens the likelihood that bubbles will form in the liquid toner 24 as it moves past the photoconductive member 68, and thereby lessens the chance that the toned electrostatic latent image on the imaging surface 66 will be distorted. The sweep alignment of the development electrode 16 with the outer circumferential imaging surface 66 of the drum 69 allows the liquid toner 24 on the development electrode 16 to be gradually applied to the imaging surface 66 and thereby ensures a high quality developed image. In addition, sweeping the development electrode 16 from the developing position back to the predeveloping position allows the vacuum source 64 to remove excess liquid toner from the imaging surface 66 of the photoconductor drum 69.

Although the present invention has been described with reference to preferred embodiments, workers skilled in the art will recognize that changes may be made in form and detail without departing from the spirit and scope of the invention.

What is claimed is:

1. A toner developing module for the application of liquid toner to an imaging surface of a photoconductive member, comprising:

a shroud;

a development electrode supported by the shroud and configured to be positioned in spaced proximity to the imaging surface of the photoconductive member;

a liquid toner supply configured to contain a supply of liquid toner;

a pump mechanism coupled to the shroud to provide a continuous flow of liquid toner to the development electrode from the supply of liquid toner;

means for allowing liquid toner that has not been deposited on the imaging surface to flow from the development electrode to the supply of liquid toner;

a vacuum chamber mounted to the shroud and positioned between the development electrode and the supply of liquid toner and in communication with the undeposited liquid toner flowing between the development electrode and the supply of liquid toner;

a vacuum source coupled to the shroud for drawing undeposited liquid toner from the development electrode and for skiving air from around the development electrode in addition to the undeposited liquid toner, said vacuum source applying a vacuum pressure to the vacuum chamber to separate skived air into the vacuum chamber; and an undeposited liquid toner return passageway coupled to the shroud for allowing undeposited liquid toner to bypass the vacuum source and the pump mechanism and flow past the vacuum chamber to the supply of liquid toner.

2. The toner developing module of claim 1 wherein the shroud includes:

a toner supply passageway coupled to an outlet line of the pump mechanism for delivering the continuous flow of liquid toner to the development electrode; and a toner overflow passageway adjacent the toner supply passageway.

3. The toner developing module of claim 2 wherein the liquid toner supply is a liquid toner supply sump associated with the shroud and configured to contain the supply of the liquid toner, and wherein an inlet line of the pump mechanism is coupled to the supply sump.

4. The toner developing module of claim 3 wherein an inlet line of the pump mechanism is coupled to the supply sump and wherein the toner return passageway includes an outlet portion submerged beneath the surface of the supply of liquid toner contained within the supply sump.

5. The toner developing module of claim 4 wherein the vacuum chamber includes an outlet coupled to the vacuum source, and an inlet coupled to the toner return passageway at a location above the outlet portion.

6. The toner developing module of claim 1 wherein the vacuum source is a vacuum pump.

7. A toner developing module for the application of liquid toner to an imaging surface of a photoconductive member, comprising:

a shroud;

a development electrode supported by the shroud and configured to be positioned in space proximity to the imaging surface of the photoconductive member;

a liquid toner supply configured to contain a supply of liquid toner;

a pump mechanism to provide a continuous flow of liquid toner to the development electrode from the supply of liquid toner;

a toner supply passageway coupled to the pump mechanism and the development electrode for delivering the continuous flow of liquid toner to the development electrode;

an inlet line configured to allow toner concentrate and toner carrier to be added to the supply sump; and an outlet line configured to allow liquid toner to be removed from the supply sump.

* * * * *